US005316103A

United States Patent [19]

Bell et al.

[11] Patent Number: 5,316,103

[45] Date of Patent: May 31, 1994

[54] ROPE GRAB DEVICE INDICATING THE EXISTENCE OF SHOCK IMPACT ON PERSONAL SAFETY

[75] Inventors: Michael Bell, 1705 Triumphe Way, Warrington, Pa. 18976; Anthony Carenzo, Audubon, Pa.

[73] Assignee: Michael Bell, Warrington, Pa.

[21] Appl. No.: 7,456

[22] Filed: Jan. 22, 1993

[51] Int. Cl.[5] ..... A62B 1/14

[52] U.S. Cl. ..... 182/18; 182/5; 182/192

[58] Field of Search ..... 182/18, 3-8, 182/191-193; 188/65.1-65.4

[56] References Cited

U.S. PATENT DOCUMENTS

| | | | |
|---|---|---|---|
| 2,294,897 | 9/1942 | Ellis . | |
| 2,428,559 | 10/1947 | Ellis . | |
| 2,613,865 | 10/1952 | Rose . | |
| 3,025,995 | 3/1962 | Koelsch et al. . | |
| 3,444,957 | 5/1969 | Ervin, Jr. . | |
| 3,801,340 | 4/1974 | Ellis . | |
| 3,804,698 | 4/1974 | Kinloch . | |
| 4,059,871 | 11/1977 | Swager | 182/5 |
| 4,253,544 | 3/1981 | Dalmaso . | |
| 4,446,944 | 5/1984 | Forrest et al. . | |
| 4,538,702 | 9/1985 | Wolner . | |
| 4,560,029 | 12/1985 | Dalmaso | 182/129 X |
| 4,877,110 | 10/1989 | Wolner . | |
| 5,220,977 | 6/1993 | Wolner | 182/18 |

*Primary Examiner*—Alvin C. Chin-Shue

*Attorney, Agent, or Firm*—Caesar, Rivise, Bernstein, Cohen & Pokotilow, Ltd.

[57] ABSTRACT

A rope grab for protecting a worker at an elevated position from a fall. The rope grab is disposed on a vertically extending safety line and is connected to the worker by a lanyard. The rope grab includes housing having a pivotable actuator mounted thereon. The actuator includes an serrated extension for engaging the safety line. A rupturable capsule containing an indicating liquid is located in the housing. The actuator is connected to the lanyard to secure the worker to the rope grab and is pivotable upon a downward pull thereon to move the serrated extension from a first position to a second position. When the serrated extension is in the first position it engages the safety line slightly to permit the rope grab to be slid therealong. When it is in the second position it tightly engages the safety line to preclude the device from being slid along said safety line, and causes the automatic rupturing of the chamber, whereupon the indicator liquid flows onto a portion of the rope grab and a portion of the safety line. The actuator is also arranged to be moved to a third intermediate position wherein the rope grab is precluded from sliding along the safety line but the capsule is not ruptured.

16 Claims, 3 Drawing Sheets

FIG. 1
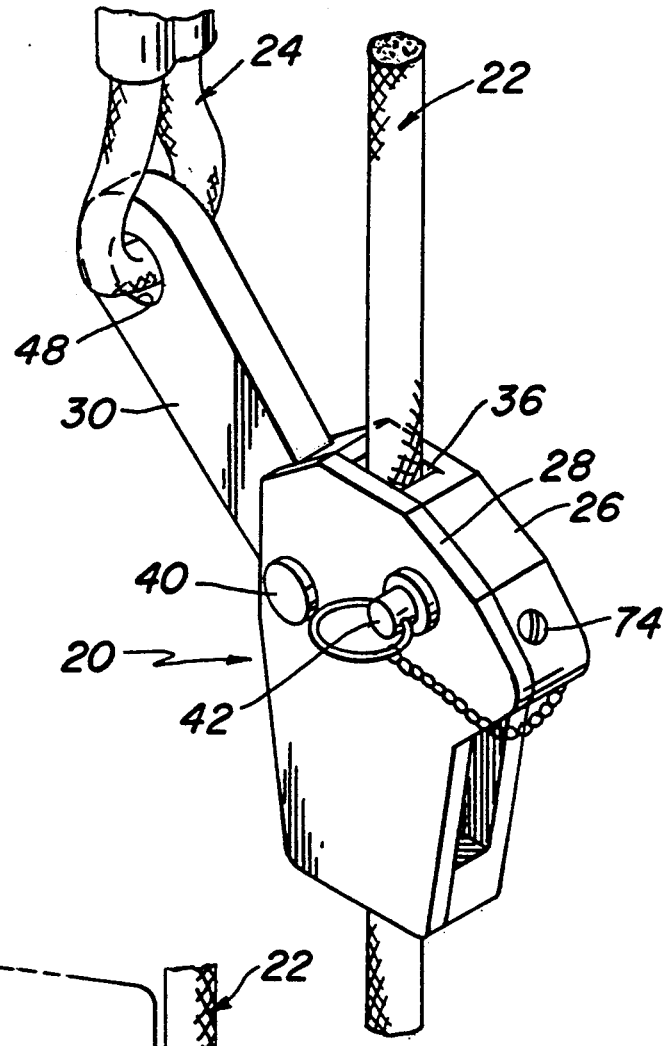
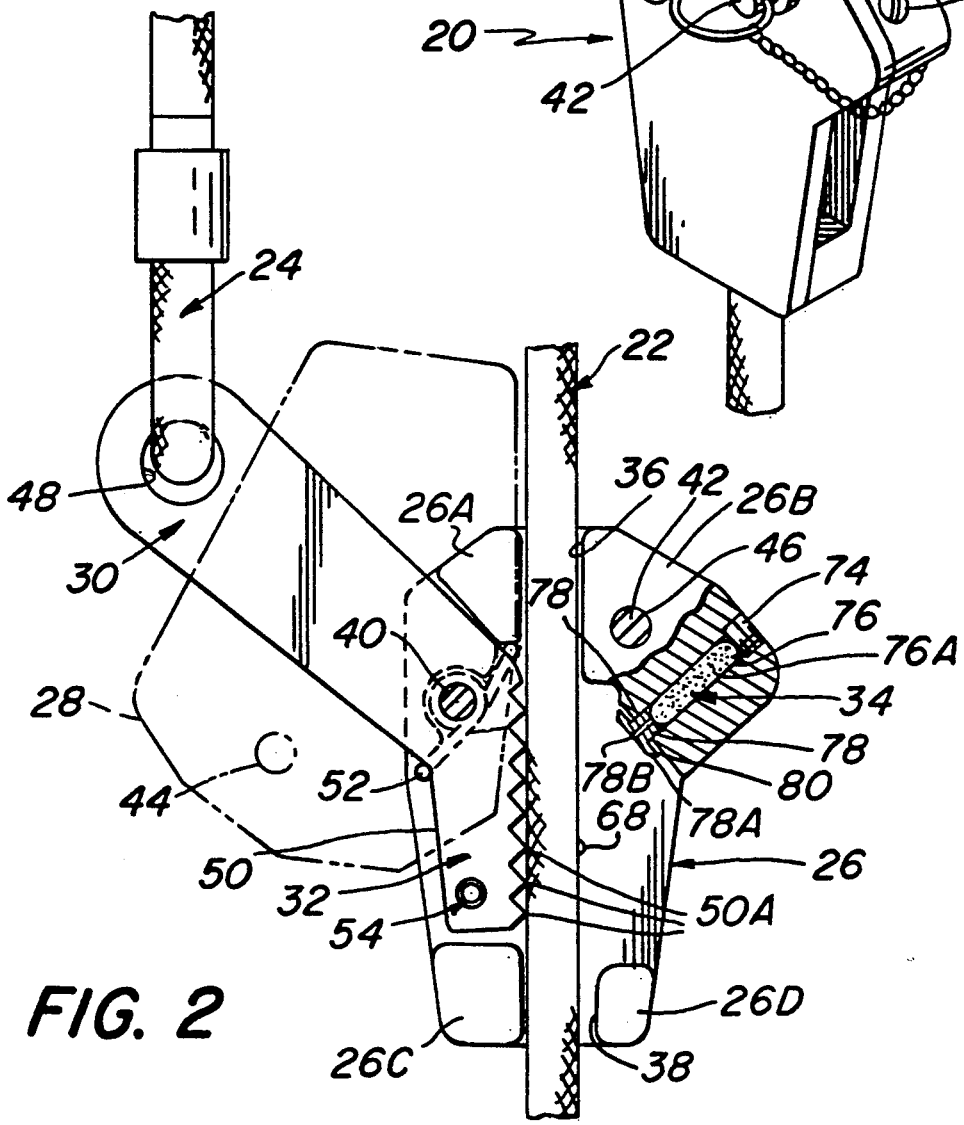
FIG. 2

FIG. 4
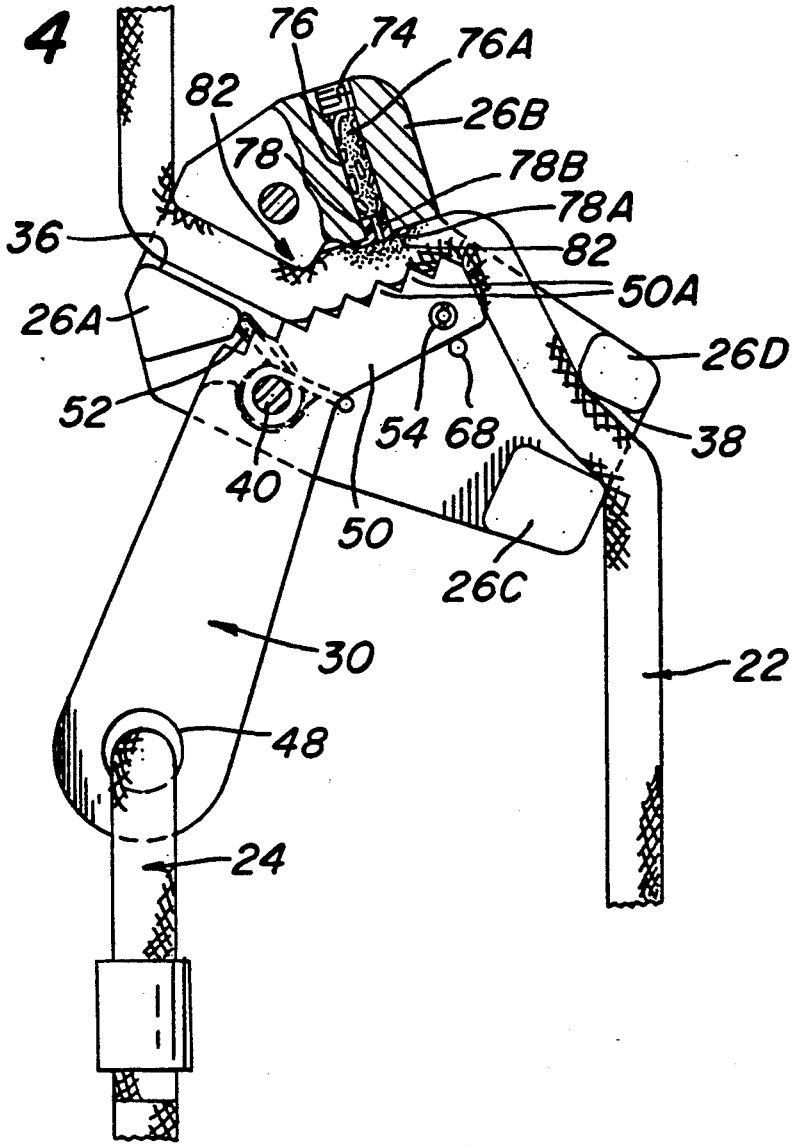
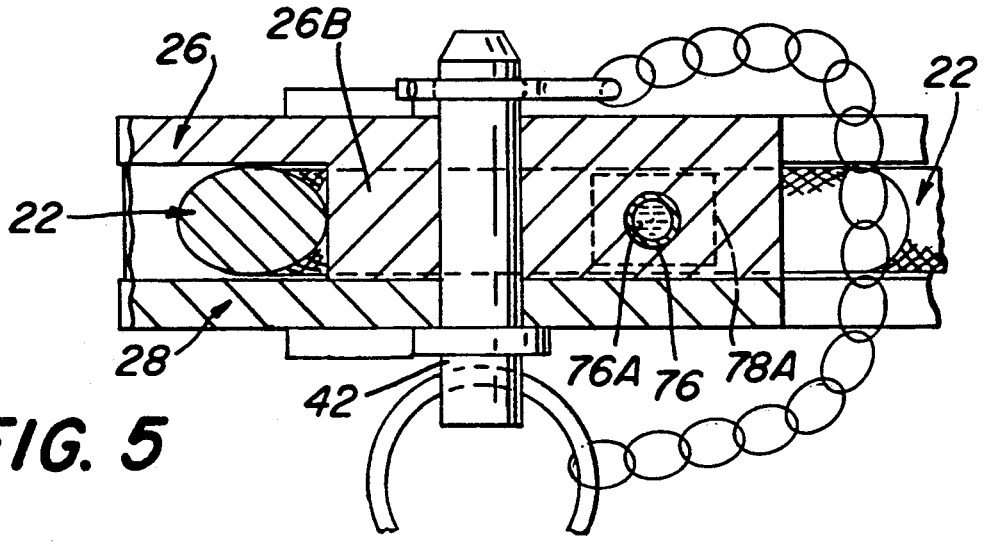
FIG. 5

ROPE GRAB DEVICE INDICATING THE EXISTENCE OF SHOCK IMPACT ON PERSONAL SAFETY

BACKGROUND OF THE INVENTION

This invention relates generally to safety apparatus and more particularly to a rope grab device for use on a safety line.

Due to the enactment of various safety laws, persons working at elevated positions, e.g., when washing the upper story windows of a building, etc., are required to be protected against falls. One common approach to achieve that end is the use of a safety belt which is worn on the worker's waist or a harness worn on the worker's torso. The belt/harness typically includes a D-ring or some other metal loop fixedly mounted on it. The D-ring is arranged to be connected, via a lanyard, to a "rope grab" device which is mounted on a safety line. The safety line typically comprises a rope, cable or other type of strong line which extends vertically from a fixed elevated anchor point downward past the point at which the worker is located. In fact in many applications the line extends all the way to the ground. The rope grab is arranged to slide along the safety line to follow the worker up or down the structure on which the worker is working. In the event that the worker should fall off of the structure the rapid downward pull on the rope grab caused by the momentum of the worker causes the rope grab to automatically immediately engage and lock itself into a fixed position on the safety line, thereby arresting the worker's fall and supporting him/her until he/she can be rescued.

While prior art rope grabs are effective for preventing falls and hence are generally suitable for their intended purposes their operation to arrest the fall of a worker may render them and/or the safety lines on which they are mounted unsuitable for safe reuse. In this regard once the rope grab has been called upon to arrest the fall of a worker the stresses imparted to it and to the safety line on which it is located may weaken the rope grab and/or the safety line to a point where reuse would be unsafe.

Heretofore, some prior art lanyards for connecting the worker's safety belt or harness to the rope grab or to a fixed anchor point in safety systems have included some means to indicate that the lanyard has been stressed by a fall. For example, in U.S. Pat. No. 4,253,54 (Dalmaso) there is disclosed a lanyard which when stressed by a fall results in the breakage of stitching and the release of a flag to indicate that occurrence. In U.S. Pat. Nos. 2,613,865 (Rose); 3,444,957 (Ervin, Jr.); 3,804,698 (Kinloch); 4,446,944 (Forrest et al.); and 4,538,702 (Wolner) there are disclosed shock absorbing safety belts or lanyards which include looped portions which are extended when the device is stressed, such as occurs when arresting a fall.

In U.S. Pat. No. 4,877,110 (Wolner) there is disclosed a safety device with a retractable lifeline which is reeled up in a housing attached to a harness worn by the worker. The end of the safety line is attached to an elevated fixed anchor point. The device includes a shear pin with a minimum predetermined amount of the lifeline wound around it within the housing so that when the safety device operates to arrest the fall of the worker the shear pin breaks and enable that predetermined amount of safety line to exit the housing. A label is located on that portion of the safety line to indicate that the safety device must be serviced or checked prior to reuse.

Other devices have been described in the patent literature for indicating the existence of stress on a member. For example U.S. Pat. No. 3,025,995 (Koelsch et al) discloses a container or case having deformable corners to indicate the absorption of a shock thereto. U.S. Pat. Nos. 2,294,897 (Ellis); 2,428,559 (Ellis); and 3,801,340 (Ellis) disclose adherent brittle films used on rigid articles which crack at predetermined strain levels to indicate stress on the articles.

Thus, the prior art has not addressed the problem of indicating the operation of a rope grab on a safety line to arrest a worker's fall so that the rope grab and/or safety line can be taken out of use for disgarding or for checking and/or refurbishment.

OBJECTS OF THE INVENTION

It is a general object of this invention to provide a rope grab which overcomes the disadvantages of the prior art.

It is a further object of this invention to provide a rope grab with means for indicating that it has been operated to arrest the fall of a worker.

It is a further object of this invention to provide a rope grab with means for providing an indication marking on it to show that it has been operated to arrest the fall of a worker.

It is a further object of this invention to provide a rope grab with means for providing an indication marking on the safety line on which the rope grab is mounted to show that the rope grab has been operated to arrest the fall of a worker.

It is a further object of this invention to provide a rope grab which is simple in construction, low in cost, and provides an effective means for indicating that it has been operated to arrest the fall of a worker.

SUMMARY OF THE INVENTION

These and other objects of this invention are achieved by providing a device for protecting a worker at an elevated position from a fall. The device is disposed on a vertically extending safety line and is connected to the worker by connection means.

The device comprises pullable actuator means, safety line engagement means, and operation indicator means. The actuator means is connectable to the connection means to secure the worker to the device and is movable upon the application of a downwardly directed force thereon. The safety line engagement means is coupled to the actuator means and is movable in response to a downwardly directed force on the actuator means from a first position to a second position. The line engagement means when in the first position permits the device to be slid along the safety line and when in the second position engages the safety line to preclude the device from being slid along the safety line.

The indicator means operates in automatic response to the line engagement means being in the second position to provide a visual indication thereof.

DESCRIPTION OF THE DRAWINGS

Other objects and many attendant features of this invention will become readily appreciated as the same becomes better understood by reference to the following detailed description when considered in connection with the accompanying drawings wherein:

FIG. 1 is an isometric view of a rope grab constructed in accordance with this invention and shown on a conventional safety line, with the rope grab being in its normal state wherein it is free to slide up or down the safety line to follow the worker connected thereto;

FIG. 2 is a slightly enlarged side elevational view, partially in section, of the rope grab of FIG. 1 shown with its cover pivoted back to reveal its internal components;

FIG. 4 is a side elevational view, like that of FIGS. 2 and 3, but showing the rope grab in its automatically engaged or "fall arresting" state for halting the fall of a worker connected thereto;, FIG. 5 is an enlarged sectional view taken along line 5—5 of FIG. 3.

DETAILED DESCRIPTION OF THE PREFERRED EMBODIMENTS

Figure 3:
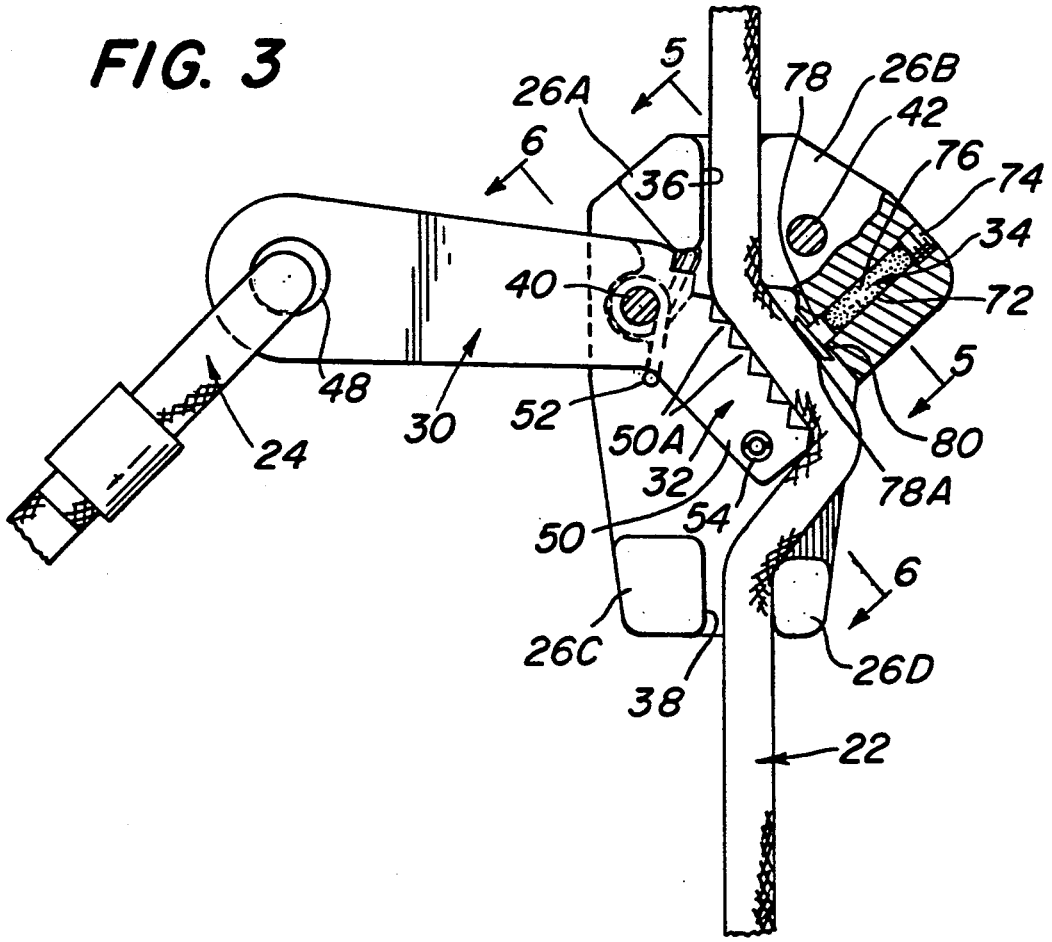
FIG. 3 is a side elevational view, like that of FIG. 2, but showing the rope grab in its manually engaged or "locked off" state to hold the rope grab in one position on the safety line.

Referring now to the various figures of the drawing wherein like reference characters refer to like parts, there is shown at 20 in FIG. 1, a rope grab constructed in accordance with this invention. The rope grab 20 is mounted on a conventional safety line 22 extending downward from a fixed anchor point (not shown) on an elevated structure (not shown) upon which the worker (not shown) is located. The worker is connected to the rope grab via a conventional lanyard 24, only one end of which can be seen (the opposite end of the lanyard being connected to a waist belt or harness worn by the worker). In the interest of safety it is preferable that the lanyard include a shock absorber to absorb the shock when the rope grab operates to arrest the worker's fall. One particularly effective shock absorbing lanyard is sold by Descent Control, Inc. under the trademark SOFT LANDING.

Referring now to FIGS. 1 and 2 it can be seen that the rope grab 20 basically comprises a housing 26, a cover 28, actuating means 30, safety line engaging means 32, and indicator means 34. The housing is formed of a relatively thick plate of a strong material, e.g., aluminum, and includes four upstanding projections 26A, 26B, 26C, and 26D located at each of its corners. The projections 26A and 26B are spaced apart from each other to form a vertically oriented channel 36 therebetween. In a similar manner projections 26C and 26D are spaced apart from each other to form a vertically oriented channel 38 therebetween. The two channels 36 and 38 are axially aligned, although channel 38 is slightly wider. The safety line 22 extends through the channels 36 and 38.

The cover 28 is formed of a thinner plate of a strong material, e.g., aluminum, and is pivotally mounted on the housing 26 via a pivot pin 40 so that it can be pivoted from the "closed" (full line) position shown in FIG. 1 to the "open" (phantom line) position shown therein. In the open position the safety line can be readily threaded through the channels 36 and 38, and then the cover can be pivoted closed to hold the safety line in place in the channels. In order to releasably lock the cover 28 in the closed position a hitch/linch pin assembly 42 is provided to extend through a pair of aligned openings 44 (FIG. 2) and 46 (FIG. 2) in the cover 28 and housing 26, respectively.

The actuating means 30 basically comprises a lever having an opening 48 at the upper end thereof. The opening 48 serves as the means for connecting it to the lanyard 24. At the inner end of the actuating lever 30 is an angled extension 50 having plural serrations or teeth 50A thereon. The serrated extension 50 forms the heretofore identified safety line engagement means 32. The actuating lever 30 is pivotally mounted on the housing 26 via the pivot pin 40 so that the serrated safety line engagement extension 50 is located in the space between the housing's corner projections 26A and 26C, and with its serrations 50A disposed immediately adjacent a portion of the safety line extending between the channels 36 and 38. A helical biasing spring 52 surrounds the pivot pin 40 and its ends are interposed between the housing's corner projection 26A and the edge of the actuating lever 30 at the point that the extension 50 merges therewith. The spring serves to bias or load the actuating lever 30 into the position shown in FIG. 2. In this position, referred to hereinafter as the "normal" operating position, the serrations 50A on the safety line engaging extension 50 are held lightly in contact with the safety line by the bias force of the spring 52. However, the resulting frictional engagement between the serrations 50A and the safety line is not sufficiently great as to preclude the rope grab 20 to be slid along the safety line. In fact, the rope grab can be readily slid therealong by a slight pull (or the effect of gravity) thereon. This feature is of considerable importance to enable the rope grab to follow the worker up or down the safety line.

When the worker desires to fix the position of the rope grab on the safety line so that it will not move, i.e., it will be "locked out", the worker pulls downward on the actuating lever 30 causing the lever to pivot inward to the position shown in FIG. 3, whereupon the serrated line engagement extension 50 deflects the safety line into the space between the housing's corner projections 26B and 26D. In order to hold the rope grab in this locked out position a detent assembly 54 is mounted in the extension 50.

Figure 6:
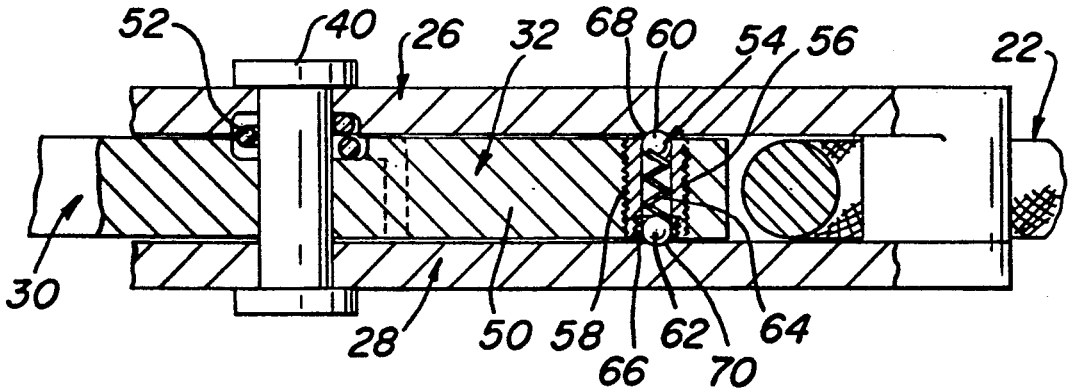
FIG. 6 is an enlarged sectional view taken along line 6—6 of FIG. 3.

The detent assembly 54 can best be seen in FIG. 6 and basically comprises a threaded hole 56 extending through the extension 50. A threaded nipple 58 is located within the hole 56. The nipple 58 includes a central passageway in which a pair of ball bearings 60 and 62 are located. A helical compression spring 64 is located within the nipple's central passageway interposed between the ball bearings 60 and 62 to bias them outward. The ball bearing 62 is located within a small threaded retaining nipple 66 at the end of the central passageway of the nipple 58. A concave recess 68 is provided in the inner surface of the housing 26 and a similar concave recess 70 is provided in the inner surface of the cover 28 to receive the ball bearings 60 and 62, respectively, therein when the rope grab is in the "locked out" position.

As mentioned earlier the rope grab 20 includes indicator means 34. That means is arranged to provide a colored indicator dye onto a portion of the rope grab 20 and onto a portion of the safety line 22 in automatic response to the operation of the rope grab in arresting the fall of the worker connected thereto. The indicator means 34 is best seen in FIGS. 3, 4, and 5 and basically comprises a bore 72 extending through the housing's corner projection 26B. A set screw 74 is threadedly engaged in the upper end of the bore to seal it. A rupturable ampoule or capsule 76 having a colored indicator dye 76A, e.g., a liquid or powder, therein is located within the bore 72 immediately in front of the set screw 74. A cap 78 is located within the bore 72 immediately in front of the capsule 76 so that the rear surface of the plug engages the front end of the capsule to hold it in place. The cap includes a peripheral flange 78A. When the set screw is tightened to the desired position it causes the capsule and cap to move slightly downward in the bore so that the peripheral flange 78A is spaced slightly at 80 (FIG. 3) from the front surface of the housing projection 26B contiguous with the bore 72. A central opening 78B is provided extending through the cap 78 to allow the dye 76A to pass therethrough when the capsule is ruptured, as will be described later.

As can be seen clearly in FIG. 3 when the rope grab is in the locked out condition, the movement of the actuating lever causes the serrated safety line extension 50 to move a portion of the safety line 22 to the position where it is immediately adjacent the flanged cap 78A of the indicator means 34. However, the safety line does not engage the cap sufficiently to move it further inward into the bore, i.e., the space 80 remains open. The detent assembly 54 holds the extension 50 in this position, thereby preventing the rupturing of the capsule.

In the event that the worker should begin to fall, the sharp downward pull on the lanyard 24 causes the actuating lever 30 to pivot downward, overcoming the retention of the actuating lever by the detent mechanism 54. Moreover, the sharp downward pull on the lanyard also causes the housing to rotate so that its bottom end is directed laterally. Accordingly, the rope grab assumes the fall arresting position shown in FIG. 4. In this position the serrations 50A of serrated safety line engagement extension 50 dig deeply into the portion of the safety line to tightly engage it and prevent slippage therebetween. Moreover, and quite significantly, the rotation of the lever 30 downward, and the concomitant rotation of the housing substantially alters the direction of the safety line, i.e., it bends the safety line from a relatively linear configuration of FIGS. 1 and 3 into a substantial zig-zag configuration, as shown in FIG. 4. These combined actions immediately prevent any movement between the rope grab and the safety line, thereby immediately arresting the fall of the worker.

Moreover, when the actuating lever 30 is brought to the fall arresting position shown in FIG. 4 the portion of the safety line engaged by the serrated extension 50 is carried smartly into engagement with the cap 78 of the indicator. This action causes the cap to move inward rapidly, thereby squeezing the capsule 76 between it and the set screw 74, whereupon the capsule ruptures and its dye contents 76A flows out the opening 78B in the cap and onto contiguous portions of the rope grab 20 and the safety line 22 to provide visible markings 82 thereon. These markings 82 show that the safety system has been shocked, i.e., called upon to arrest the fall of a worker.

The rope grab and the safety line may then be discarded so as not to be used again, or may be subjected to testing to see if their structural integrity has not been degraded below a safe level so that they may be reused or reconditioned.

Without further elaboration, the foregoing will so fully illustrate our invention that others may, be applying current or future knowledge, adopt the same for use under various conditions of service.

We claim:

1. A device for protecting a worker at an elevated position from a fall, said device being disposed on a vertically extending safety line and connected to said worker by connection means, said device comprising pullable actuator means, safety line engagement means, and operation indicator means, said actuator means being connectable to said connection means to secure said worker to said device and being movable upon the application of a downwardly directed force thereon, said safety line engagement means being coupled to said actuator means and movable in response to a downwardly directed force on said actuator means from a first position to a second position, said line engagement means when in said first position permitting said device to be slid along said safety line and when in said second position engaging said safety line to preclude said device from being slid along said safety line, said indicator means operating in automatic response to said line engagement means being in said second position to provide a visual mark on at least one of said device and said safety line.

2. The device of claim 1 wherein said at least one of said device and said safety line comprises said device.

3. The device of claim 1 wherein said at least one of said device and said safety line comprises said safety line.

4. The device of claim 1 wherein said indicator means provides a visible mark on said device and on said safety line.

5. The device of claim 1 wherein said indicator means comprises a rupturable chamber containing a flowable colored indicator medium therein.

6. The device of claim 5 wherein said movement of said line engagement means to said second position moves a portion of said safety line to rupture said rupturable chamber.

7. The device of claim 5 wherein the rupture of said rupturable chamber causes said flowable colored indicator medium to flow onto a portion of said device.

8. The device of claim 5 wherein the rupture of said rupturable chamber causes said flowable colored indicator medium to flow onto a portion of said safety line.

9. The device of claim 8 wherein the rupture of said rupturable chamber causes said flowable colored indicator medium to flow onto a portion of said device.

10. The device of claim 5 wherein said device comprises a housing and wherein said rupturable chamber is mounted within a bore in said housing, said bore having a movable plug therein, said plug having an aperture therein and being mounted within said bore and interposed between said line engagement means and said rupturable chamber.

11. The device of claim 6 wherein said device comprises a housing and wherein said rupturable chamber is mounted within a bore in said housing, said bore having a movable plug therein, said plug having an aperture therein and being mounted within said bore and interposed between said safety line and said rupturable chamber.

12. The device of claim 1 wherein said line engagement means is movable to a third position, said third position being intermediate said first and second positions wherein said device is precluded from sliding along said safety line but said indicator means is not operated.

13. The device of claim 12 wherein said actuator means comprises a pivotable member, and wherein said line engagement means comprises an extension of said pivotable member.

14. The device of claim 12 additionally comprising detent means to hold said line engagement means in said third position.

15. The device of claim 13 wherein said actuator mean is spring loaded.

16. The device of claim 14 wherein said actuator mean is spring loaded.

* * * * *